US006305504B1

(12) United States Patent
Ring

(10) Patent No.: US 6,305,504 B1
(45) Date of Patent: Oct. 23, 2001

(54) SUSPENSION SYSTEM FOR A CAR MOUNTED BRAKE ASSEMBLY

(75) Inventor: Michael E. Ring, Crown Point, IN (US)

(73) Assignee: Westinghouse Air Brake Company, Wilmerding, PA (US)

( * ) Notice: Subject to any disclaimer, the term of this patent is extended or adjusted under 35 U.S.C. 154(b) by 0 days.

(21) Appl. No.: 09/397,827

(22) Filed: Sep. 17, 1999

(51) Int. Cl.[7] ..... B61H 13/00
(52) U.S. Cl. ..... 188/52; 188/219.1
(58) Field of Search ..... 188/52, 56, 58, 188/158 R, 219.1, 222.1, 223.1, 223.6, 224.1, 225.6, 226.1, 228.1, 228.6, 229.1, 229.6, 231, 232, 233.3, 233.7

(56) References Cited

U.S. PATENT DOCUMENTS

| | | | | |
|---|---|---|---|---|
| Re. 33,207 | * | 5/1990 | Brodeur et al. | 188/1.11 |
| 5,259,485 | * | 11/1993 | Jackson | 188/198 |
| 5,452,776 | * | 9/1995 | Kohler | 188/58 |
| 6,148,966 | * | 11/2000 | Daugherty, Jr. et al. | 188/52 |

* cited by examiner

*Primary Examiner*—Christopher P. Schwartz
(74) *Attorney, Agent, or Firm*—James Ray & Associates

(57) ABSTRACT

An improved car mounted brake assembly is provided wherein the brake assembly includes a brake cylinder, a slack adjuster and a pair of brake beams mounted at each end of the car mounted brake assembly and actuated by the brake cylinder via a series of levers and linkages and wherein the improvement comprises a suspension system for suspending each of the brake beams within a corresponding railway vehicle truck arrangement. Each of the brake beams have a brake head attachable to each end thereof and each of the brake heads carries a brake shoe thereon which is positioned for engagement with a respective railway vehicle wheel during a brake application. The railway vehicle truck arrangement within which the brake beams are suspended includes a pair of truck side frames and a truck bolster member. The suspension system comprises a first device pivotally connected at a first end thereof with a predetermined portion of the railway vehicle truck arrangement and pivotally connected at a second end thereof to a predetermined portion of the car mounted brake assembly for suspending the pair of brake beams in the railway vehicle truck arrangement. The suspension system also includes a second device having at least a portion thereof connected with the car mounted brake assembly for maintaining each of the brake beams in a predetermined plane during application and release of the railway vehicle brake assembly.

15 Claims, 7 Drawing Sheets

FIG. 7
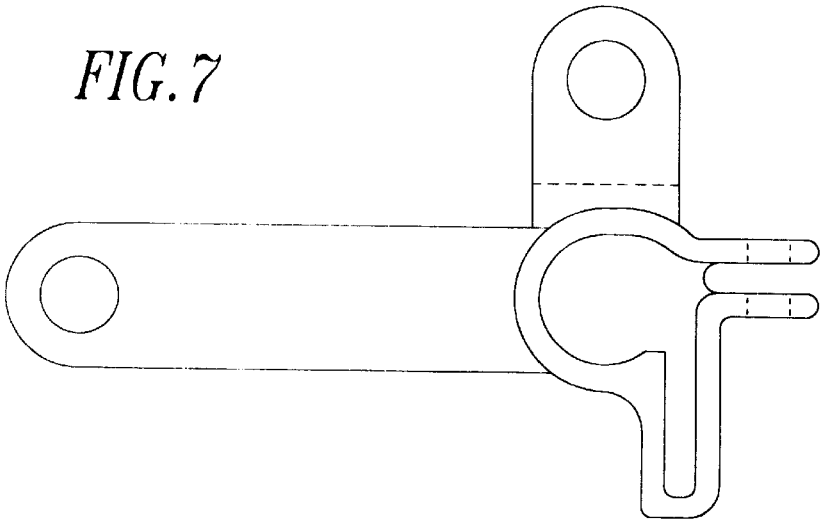
FIG. 8
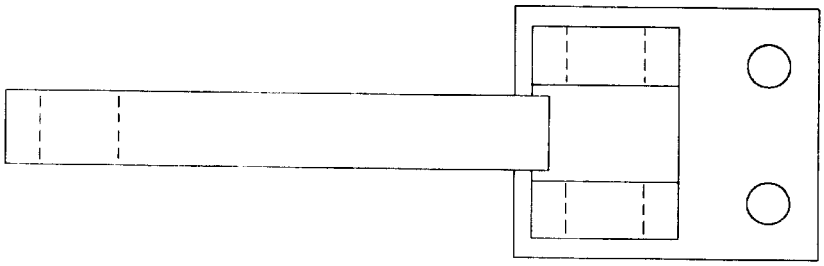
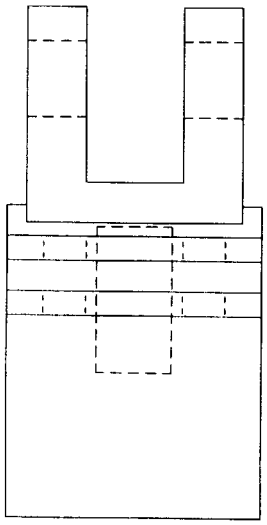
FIG. 9

SUSPENSION SYSTEM FOR A CAR MOUNTED BRAKE ASSEMBLY

CROSS-REFERENCE TO RELATED APPLICATIONS

This patent application is closely related to a patent application Ser. No. 09/317,514, entitled "A Suspension System for a Truck Mounted Brake Assembly", filed May 24, 1999 and is assigned to Westinghouse Airbrake Company, the assignee of the present invention. The teachings of this co-pending patent application are incorporated herein by reference thereto.

FIELD OF THE INVENTION

The present invention relates, in general, to a car mounted brake assembly for a railway vehicle and, more particularly, to a car mounted brake assembly having a pair of brake beams and a suspension system for suspending each of such pair of brake beams within a railway vehicle truck arrangement.

BACKGROUND OF THE INVENTION

Car mounted brake assemblies are well known in the railway industry. These brake assemblies typically include a brake cylinder, a slack adjuster and a pair of brake beams mounted at each end of the car. A railway vehicle truck arrangement is provided at each end of the brake assembly. Each of the truck arrangements include a bolster and a pair of side frames having a wheel and axle set at each end of each pair of the truck side frames. The brake beams are typically mounted within a channel in the truck side frames of the railway vehicle truck arrangement. The brake beams are actuated by the brake cylinder via a series of levers and linkages. Each of these brake beams have a brake head attachable to each end thereof and each of the brake heads carries a brake shoe thereon. The brake heads are positioned such that during a brake application, the brake shoes engage the railway vehicle wheels causing the railway vehicle to stop.

In the U.S. railway industry, the side frame is fixed to the wheel and axle and the brake beams are secured to the truck side frame. This type of mounting of the brake beams subjects the braking system to a significant amount of shock as the railway vehicle moves along a route. Additionally, due to this type of mounting, occasionally, full contact is not made between the brake shoes and the wheels as the car moves up and down.

This differs from the European railway industry braking system. In the European market, presently used individual braking systems are suspended within the truck arrangement so that the braking system becomes part of the sprung system of the vehicle, giving the braking system more cushion and preventing shock onto the system.

A significant drawback to the systems currently in use in the European market is that these braking systems require the use of such an individual brake unit at each wheel, significantly increasing the cost of the braking system and the cost of maintaining each of these individual units. Another disadvantage is that the use of an individual braking unit at each wheel significantly increases the weight of the carsets, as well as, the energy required to power the railway vehicle.

SUMMARY OF THE INVENTION

An improved car mounted brake assembly is provided wherein the brake assembly includes a brake cylinder, a slack adjuster and a pair of brake beams mounted at each end of the car mounted brake assembly and actuated by the brake cylinder via a series of levers and linkages and wherein the improvement comprises a suspension system for suspending each of the brake beams within a corresponding railway vehicle truck arrangement. Each of the brake beams have a brake head attachable to each end thereof and each of the brake heads carries a brake shoe thereon which is positioned for engagement with a respective railway vehicle wheel during a brake application. The railway vehicle truck arrangement within which the brake beams are suspended includes a pair of truck side frames and a truck bolster member. The suspension system comprises a first means pivotally connected at a first end thereof with a predetermined portion of the railway vehicle truck arrangement and pivotally connected at a second end thereof to a predetermined portion of the car mounted brake assembly for suspending the pair of brake beams in the railway vehicle truck arrangement. The suspension system also includes a second means having at least a portion thereof connected with the car mounted brake assembly for maintaining each of the brake beams in a predetermined plane during application and release of the railway vehicle brake assembly.

OBJECTS OF THE INVENTION

It is an object of the present invention to provide a car mounted brake assembly having a suspension system for suspending a pair of brake beams within a railway vehicle truck arrangement.

It is a further object of the invention to provide a car mounted brake assembly having a suspension system for suspending a pair of brake beams within a railway vehicle truck arrangement which provides more cushion and reduces the amount of shock endured by the braking system.

It is yet a further object of the invention to provide a car mounted brake assembly having a suspension system for suspending a pair of brake beams within a railway vehicle truck arrangement so as to achieve full contact of the brake shoes against the wheel as the car moves up and down allowing for an even wear of the brake shoes and better energy efficiency.

It is another object of the invention to provide a car mounted brake assembly having a suspension system for suspending a pair of brake beams within a railway vehicle truck arrangement so that this truck mounted brake suspension system may be utilized in a broader range of braking systems.

It is yet a further object of the invention to provide a car mounted brake assembly having a suspension system for suspending a pair of brake beams within a railway vehicle truck arrangement which provides a braking system having greater energy efficiency, requires less maintenance and is less expensive.

Although a number of objects and advantages of the present invention have been described in some detail above, various additional objects and advantages of the car mounted brake assembly having a suspension system for suspending a pair of brake beams within a railway vehicle truck arrangement will become more readily apparent to those persons who are skilled in the art from the following more detailed description of the invention, particularly, when such detailed description of the invention is taken in conjunction with both the attached drawing figures and with the appended claims.

BRIEF DESCRIPTION OF THE DRAWINGS

FIG. 7 is a side view of an example of the link member which may be used in the suspension system.

FIG. 8 is a front view of the link member illustrated in FIG. 7.

FIG. 9 is an end view of the link member illustrated in FIG. 7.

DETAILED DESCRIPTION OF THE INVENTION

Figure 1:
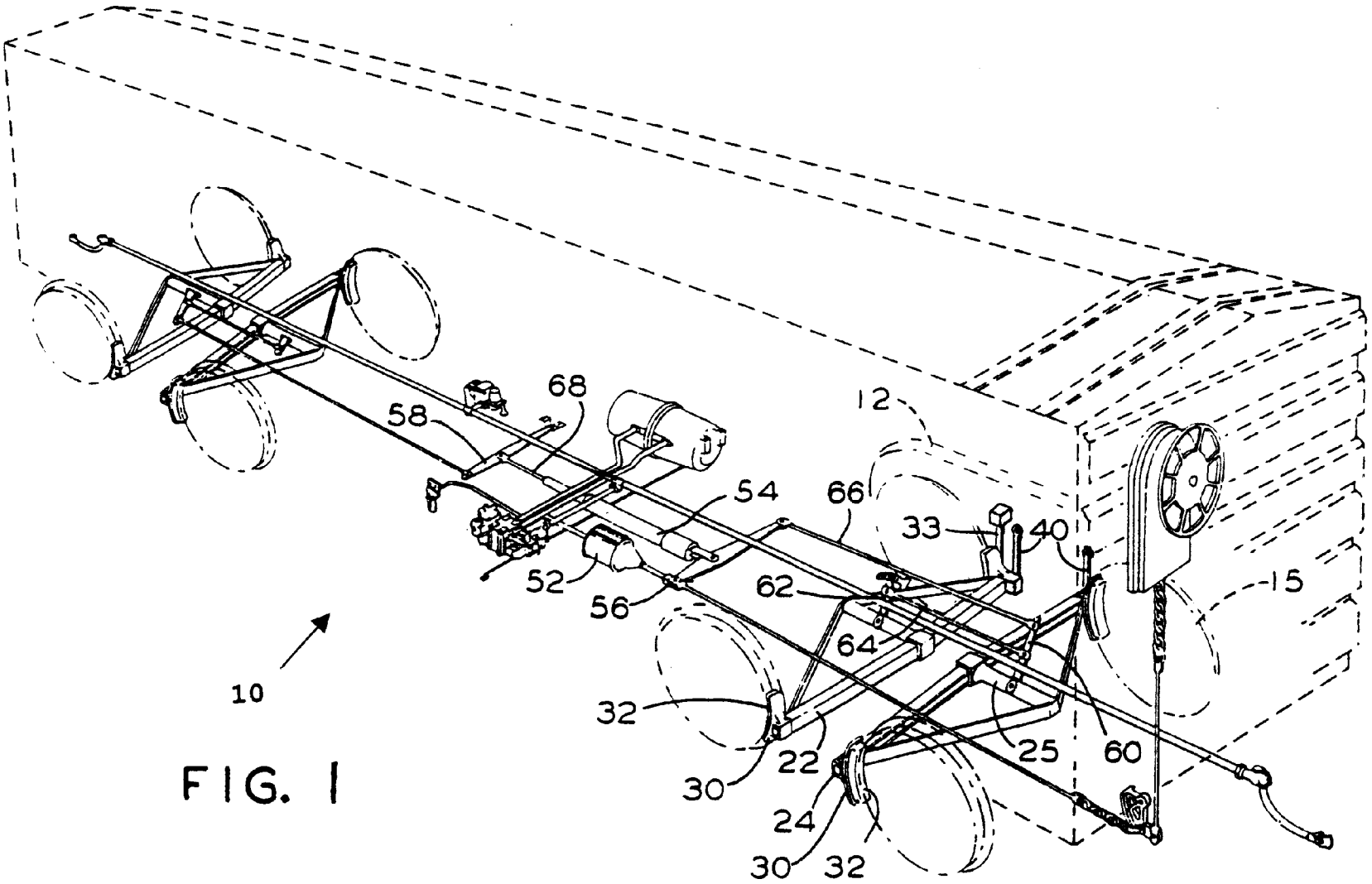
FIG. 1 is a perspective view illustrating a car mounted brake assembly having a suspension system for suspending the brake beams within the railway vehicle truck arrangement according to a first embodiment of the invention wherein the suspension system includes a series of link members pivotally connected with the side frames of the railway vehicle.

Prior to proceeding with the more detailed description of the invention, it should be noted that for the sake of clarity, identical components which have identical functions have been identified with identical reference numerals throughout the several views illustrated in the attached drawing Figures.

Referring now to the Figures there is shown a car mounted brake assembly, generally designated 10, for a railway vehicle (not shown). The car mounted brake assembly 10 includes a brake cylinder 52, a slack adjuster 54 and a pair of brake beams 22 and 24 mounted at each end of the car mounted brake assembly 10. These brake beams 22, 24 are actuated by the brake cylinder 52 via a series of levers and linkages. Brake levers are used throughout the braking system to transmit, increase, or decrease braking force, as well as to transfer or change direction of force. There are two basic categories of levers. The first category is body levers such as the cylinder lever 56 and the fulcrumed lever 58. The second category of levers is the truck levers, such as the live lever 60 and the dead lever 62. Truck lever connections, or bottom rods 64, are provided which can extend through or under the bolster 16 (shown in FIG. 6). This rod is used to transfer the force from the live lever 60 to the dead lever 62. A top rod 66 connects the truck levers 60, 62 with the body levers 56, 58 and a center rod 68 connects the two body levers 56, 58. Thus, during a braking situation wherein a force is applied by the brake cylinder 52, these levers and rods transmit and deliver braking forces to the brake beams 22 and 24 and, consequently, to the brake heads 30 and brake shoes 32 mounted thereon.

The present invention improves upon the car mounted braking system in that it provides a suspension system for suspending each of the brake beams 22, 24 within a corresponding railway vehicle truck arrangement, generally designated 20. Each of the brake beams 22, 24 have a brake head 30 attachable to each end thereof and each of the brake heads 30 carries a brake shoe 32 thereon. Such brake shoes 32 is positioned for engagement with a respective railway vehicle wheel 15 during a brake application. The railway vehicle truck arrangement 20 within which the brake beams 22, 24 are suspended includes a pair of truck side frames 12 and a truck bolster member 16.

The suspension system comprises a first means pivotally connected at a first end thereof with a predetermined portion of the railway vehicle truck arrangement 20 and pivotally connected at a second end thereof to a predetermined portion of the car mounted brake assembly 10 for suspending the pair of brake beams 22, 24 in the railway vehicle truck arrangement 20. The suspension system also includes a second means having at least a portion thereof connected with the car mounted brake assembly 10 for maintaining each of the brake beams 22, 24 in a predetermined plane during application and release of the railway vehicle brake assembly 10.

Figure 2:
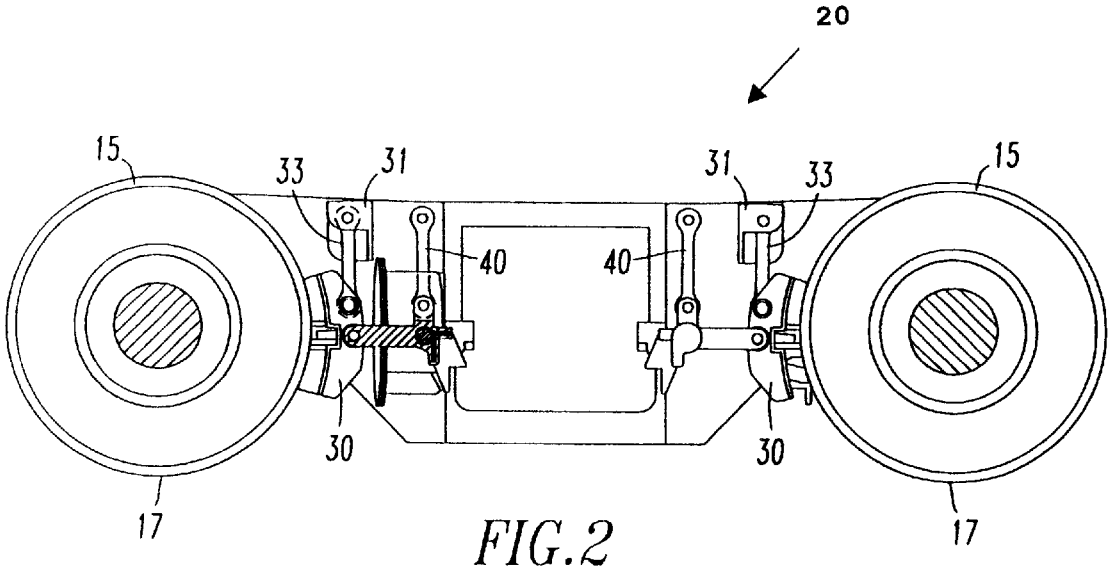
FIG. 2 is a schematic side elevation view illustrating the suspension system shown in FIG. 1.
Figure 3:
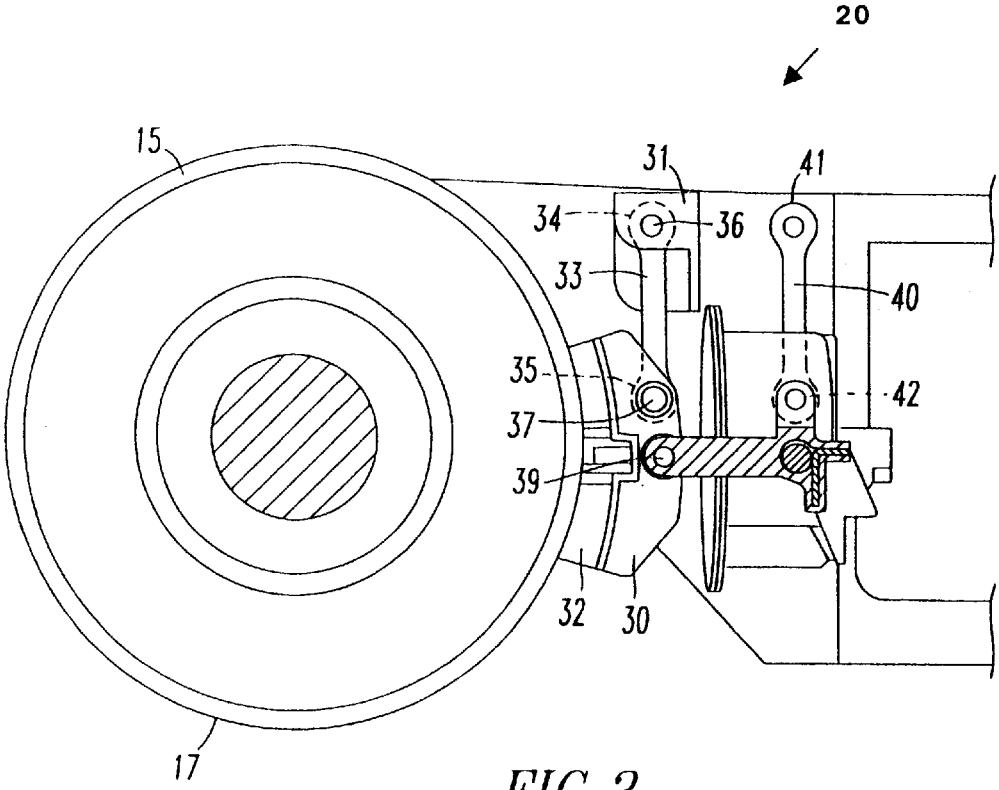
FIG. 3 is a partial side elevation view of the brake head/railway wheel arrangement of the suspension system illustrated in FIG. 1.
Figure 6:
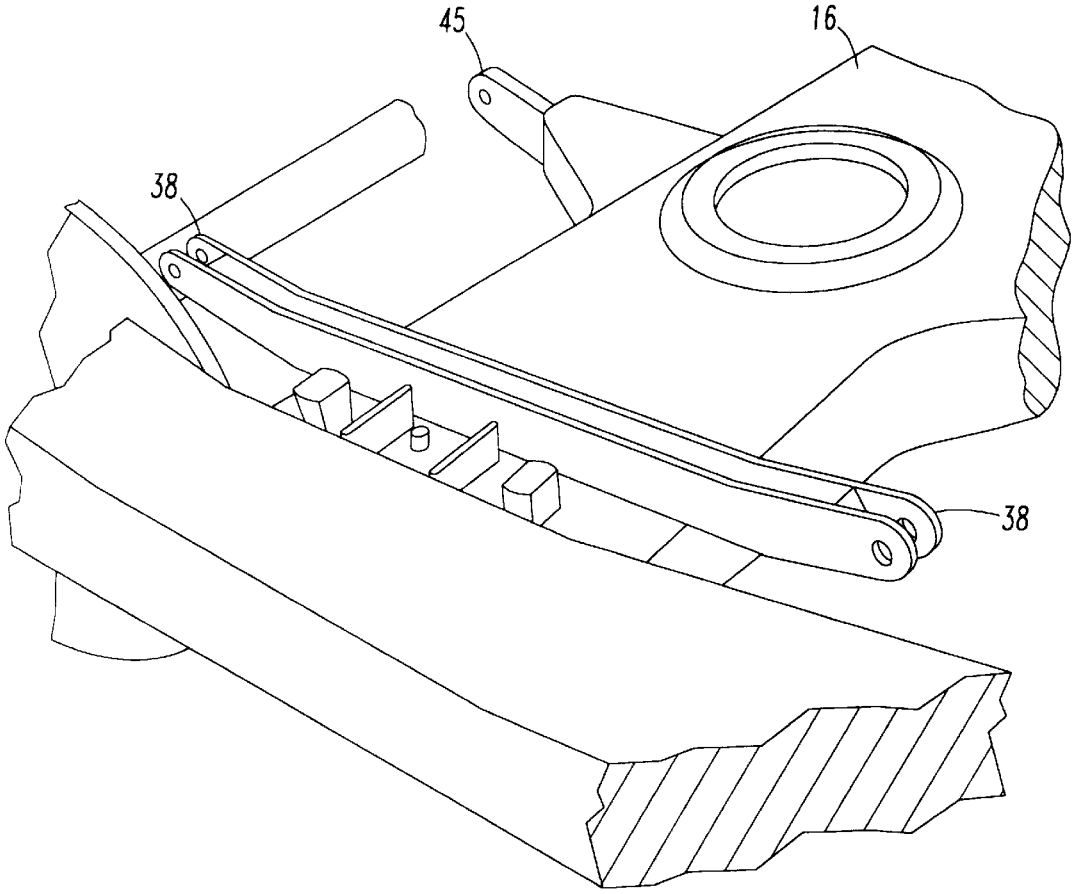
FIG. 6 is a truck arrangement including extension members on the truck bolster member enabling the use of the truck bolster member as an alternative location for pivotal attachment of the series of link members.
Figure 10:
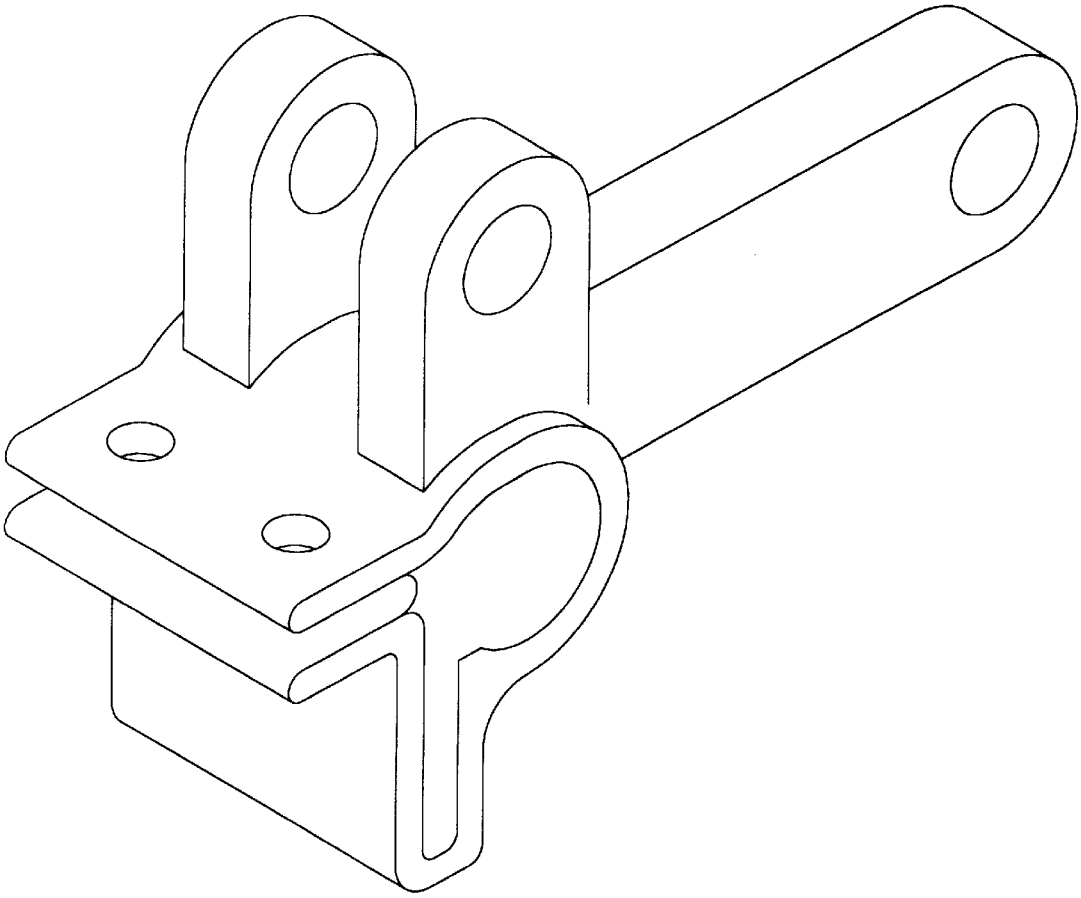
FIG. 10 is a perspective view of the link member illustrated in FIG. 7.

Referring now to FIGS. 1–3, there is shown a first embodiment of a suspension system for suspending the truck mounted brake assembly 20. In this embodiment, the first means for suspending the brake beams 22, 24 within the truck arrangement 20 includes at least two suspension link members 33 having a first end 34 and a second end 35. The first end 34 of each of the suspension link members 32 is pivotally attachable with each of the truck side frames 12 and the second end 35 of each of the suspension link members 33 is pivotally attachable with a respective one of the brake heads 30. An extension member 31 may be provided on the truck side frames 12 to enable attachment of the suspension link members 33 thereto. Alternatively, the first end 34 of each of the suspension link members 32 may be pivotally attachable with the truck bolster member 16 via extension members 38, as shown in FIG. 6, which are placed at each end of the truck bolster member 16. These extension members 31 may be any shape which is sufficiently long enough so as to enable the link member to hang therefrom substantially in alignment with the location upon which attachment of the link member is desired.

The pivotal attachment of the first end 34 of the suspension link members 33 with the railway vehicle truck arrangement 20 forms a first pivot point 36 and the pivotal attachment of the second end 35 of the suspension link members 33 with the brake heads 30 form a second pivot point 37. These brake heads 30 are attached to the brake beams 22, 24 via a third pivot point 39. These pivotal attachments allow the brake heads 30 to pivot about the second 37 and third 39 pivot points such that the brake heads 30 carrying the brake shoes 32 are capable of matching a radius 17 of the railway vehicle wheel 15 during a brake application.

The second means for maintaining each of the brake beams 22, 24 in a predetermined plane during application and release of the railway vehicle brake assembly 10 includes at least two maintaining link members 40 having a first end 41 and a second end 42. The first end 41 of each of the maintaining link members is pivotally attachable with either the truck side frames 12 or alternatively, the truck bolster member 16 via extension members 38, as illustrated in FIG. 6. An extension member (not shown) can be provided for enabling attachment of link members 40 to the side frames 12. The second end 42 of each of the maintaining link members 40 are pivotally attachable with a respective one of the pair of brake beams 22, 24.

The above described embodiment illustrates a suspension system which utilizes a total of eight link members per truck arrangement 20. A second embodiment would reduce this number of link members to six per truck arrangement 20. This second embodiment would replace the two maintaining link members 40 which are secured to each of the brake beams 22 and 24 with a single maintaining link member per brake beam. This single link member per brake beam would include a first end and a second end wherein the first end of each of the maintaining link members is pivotally attachable with the truck bolster member 16 and the second end of each of the maintaining link members is pivotally attachable with a respective one of the strut members 25. This pivotal attachment of the maintaining link members between the truck bolster 16 and the strut members 25 is achieved via an extension member 45, as illustrated in FIG. 6. Thus, this embodiment would reduce the number of link members for suspending the brake beams 22, 24 within the truck arrangement 20 from eight to six link members per truck arrangement.

An alternative to the second embodiment would be to eliminate the suspension link members 33 attached to the brake heads 30 and replace these link members 33 with a single link member mounted to each of the strut members 25. In this alternative embodiment, the link members 40 attached between the side frames 12 or bolster 16 and the brake beams 22, 24 would perform the function of suspending the braking system. The single link members would include a first end and a second end wherein the first end of each of the link members is pivotally attachable with the truck bolster member 16 and the second end of each of the single link members is pivotally attachable with a respective one of the strut members 25. This pivotal attachment of the single link members between the truck bolster 16 and the strut members 25 is achieved via an extension member 45, as illustrated in FIG. 6.

Figure 4:
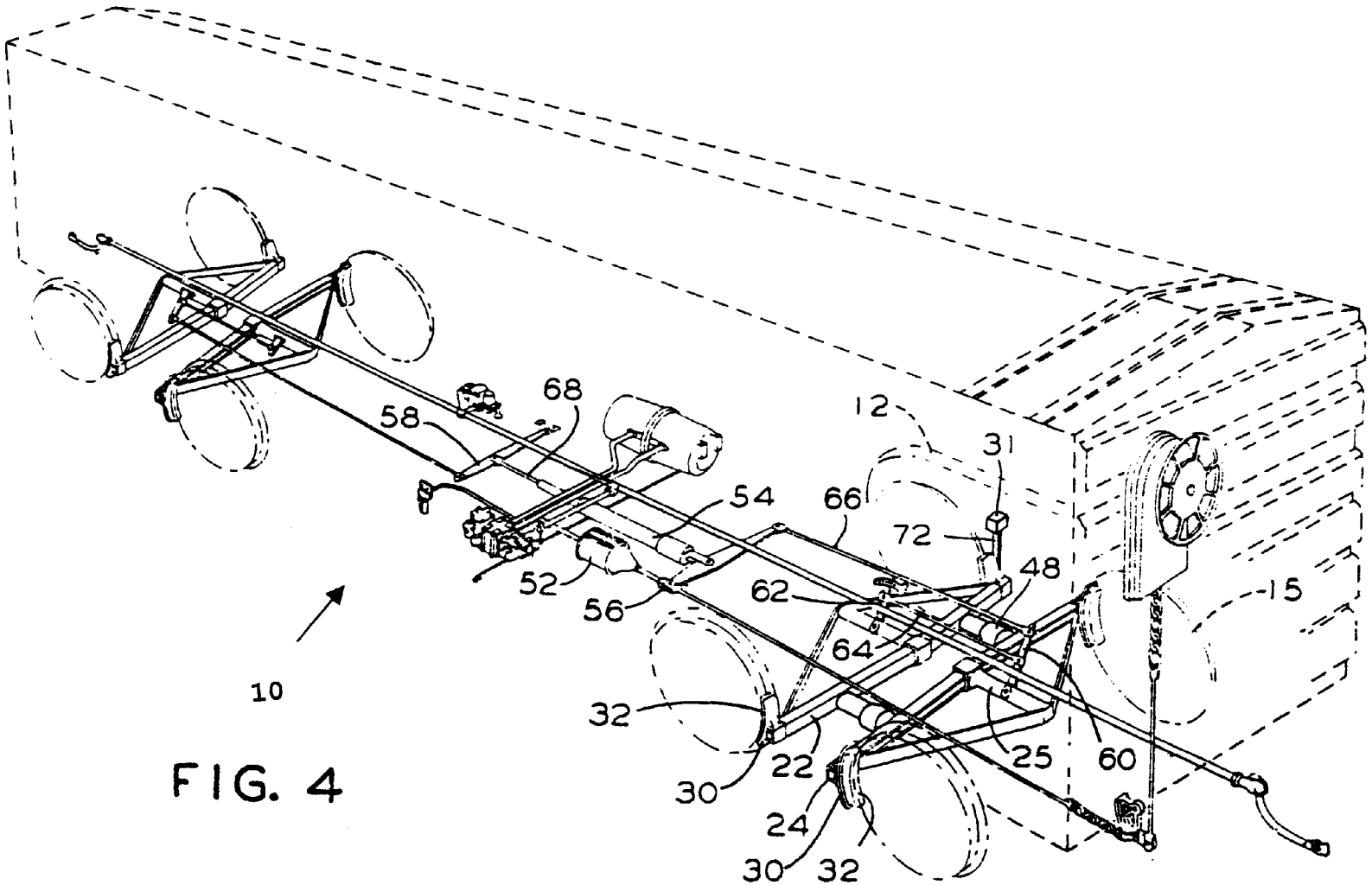
FIG. 4 is a perspective view illustrating the car mounted brake assembly having a suspension system according to an alternative embodiment of the invention wherein the suspension system includes a series of link members pivotally connected with the truck arrangement and a telescoping member disposed between and attached to the pair of brake beams.
Figure 5:
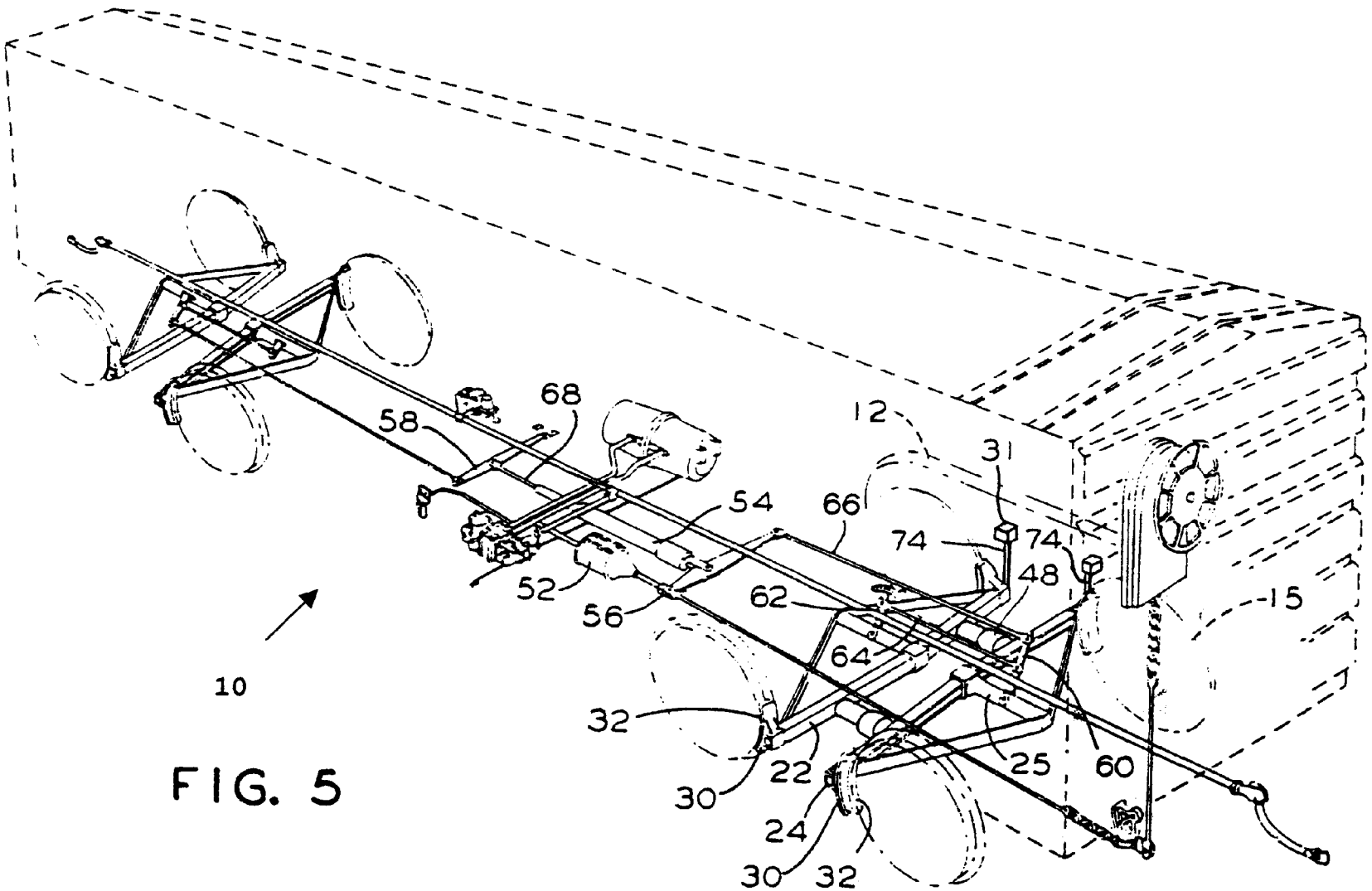
FIG. 5 is a perspective view illustrating the car mounted brake assembly having a suspension system similar to that illustrated in FIG. 4 wherein the series of link members are connected with the truck arrangement in an alternative location.

A third embodiment of the invention would further reduce the number of hanging links necessary for suspending the brake beams within the truck arrangement to four per truck arrangement 20. In this embodiment, as illustrated in FIGS. 4 and 5, a telescoping member 48 is disposed between and connected to each one of the pair of brake beams 22, 24. This telescoping member 48 would be capable of maintaining the brake beams 22 and 24 in a predetermined plane during application and release of the railway vehicle brake assembly 10. The telescoping member also would be capable of shortening and lengthening as needed during application and release of the brakes.

In FIG. 4, this telescoping member 48 works in combination with suspension link members 72 which are pivotally attached between the truck side frames 12 and the brake heads 30. An extension member 31 may be provided for attaching the suspension link members 72 from the truck side frames 12. Note that these suspension link members 72 may be alternatively attached with the truck bolster 16 via extension members 38 as illustrated in FIG. 6.

In FIG. 5, the telescoping means works in combination with suspension link members 74 which are pivotally attached between the truck side frames 12 and the brake beams 22, 24. Once again, note that an extension member on the truck side frames 12 may be provided for attaching the link members 74 therefrom. Also, note that these suspension link members 74 may be alternatively attached with the truck bolster 16 via extension members 38 as illustrated in FIG. 6.

An advantage of the hanging link members of the suspension system of the invention is that these link members enable the suspension system to be mounted in a predetermined position such that as brake shoe wear occurs, the brake assembly is capable of compensating for this brake shoe wear so as to substantially maintain a predetermined distance between each of such brake shoes and such railway vehicle wheels.

FIGS. 7–10 show a side view, top view, end view, and perspective view, respectively of the preferred link member for use in the suspension system of the invention.

Note that the suspension system of the present invention may be applicable to other types of car mounted braking systems which have not been illustrated in the Figures.

Thus the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. In a car mounted brake assembly including a brake cylinder, a slack adjuster and a pair of brake beams mounted at each end of such car mounted brake assembly, such brake beams being actuated by such brake cylinder via a series of levers and linkages, each of such brake beams having a brake head attachable to each end thereof, each of such brake heads carrying a brake shoe thereon, each of such brake heads being positioned for engagement of a respective one of such brake shoes with a respective railway vehicle wheel during a brake application: the improvement comprising a suspension system for suspending each of such pair of brake beams within a railway vehicle truck arrangement, such railway vehicle truck arrangement including a pair of truck side frames and a truck bolster member, said suspension system comprising:

(a) a first means pivotally connected at a first end thereof with a predetermined portion of one of such pair of truck side frames and such truck bolster member and pivotally connected at a second end thereof to a predetermined portion of such car mounted brake assembly for suspending such pair of brake beams in such railway vehicle truck arrangement; and (b) a second means having at least a portion thereof connected with such car mounted brake assembly for maintaining each of such brake beams in a predetermined plane during application and release of such railway vehicle brake assembly.

2. The improvement according to claim 1, wherein said first means includes at least two suspension link members having a first end and a second end, said first end of each of said suspension link members being pivotally attachable with one of each of such truck side frames and such truck bolster member and said second end of each of said suspension link members being pivotally attachable with a respective one of such brake heads.

3. The improvement according to claim 2, wherein such car mounted brake assembly includes a strut member securable with each of such brake beams and said second means includes at least two maintaining link members having a first end and a second end, said first end of each of said maintaining link members being pivotally attachable with such truck bolster member and said second end of each of said maintaining link members being pivotally attachable with a respective one of such strut members.

4. The improvement according to claim 3, wherein such truck bolster member includes an extension member substantially in alignment with each of such strut members allowing for a pivotal connection of said second means with such strut members and with such truck bolster member.

5. The improvement according to claim 2, wherein said pivotal attachment of said first end of said suspension link members with such railway vehicle truck arrangement forms a first pivot point and said pivotal attachment of said second end of said suspension link members with such brake heads forms a second pivot point.

6. The improvement according to claim 5, wherein such brake heads are attached to such brake beams via a third pivot point allowing such brake heads to pivot about said second and third pivot points such that such brake heads carrying such brake shoes are capable of matching a radius of such railway vehicle wheel during a brake application.

7. The improvement according to claim 2, wherein said second means includes at least two maintaining link members having a first end and a second end, said first end of each of said maintaining link members being pivotally attachable with one of each of such truck side frames and such truck bolster member and said second end of each of said maintaining link members being pivotally attachable with a respective one of such pair of brake beams.

8. The improvement according to claim 2, wherein said second means includes a telescoping member disposed between and connected to each one of such pair of brake beams.

9. The improvement according to claim 1, wherein said first means includes at least two suspension link members having a first end and a second end, said first end of each of said suspension link members being pivotally attachable with one of each of such truck side frames and such truck bolster member and said second end of each of said suspending link members being pivotally attachable with a respective one of such pair of brake beams.

10. The improvement according to claim 9, wherein such car mounted brake assembly includes a strut member securable with each of such brake beams and said second means includes at least two maintaining link members having a first end and a second end, said first end of each of said maintaining link members being pivotally attachable with such truck bolster member and said second end of each of said maintaining link members being pivotally attachable with a respective one of such strut members.

11. The improvement according to claim 10, wherein such truck bolster member includes an extension member substantially in alignment with each of such strut members allowing for a pivotal connection of said second means with such strut members and with such truck bolster member.

12. The improvement according to claim 9, wherein said second means includes a telescoping member disposed between and connected to each one of such pair of brake beams.

13. The improvement according to claim 1, wherein said suspension system is capable of being mounted in a predetermined position such that as brake shoe wear occurs, such brake assembly is capable of compensating for brake shoe wear so as to substantially maintain a predetermined distance between each of such brake shoes and such railway vehicle wheels.

14. The improvement according to claim 1, wherein such truck bolster member includes a pair of extension members at each end thereof allowing for a pivotal connection of said first means with such truck bolster member.

15. The improvement according to claim 1 wherein each of such truck side frames include extension members attached thereto allowing for pivotal attachment of at least one of said first and second means with such truck side frames.

* * * * *